US006628255B1

(12) United States Patent
Ferrel et al.

(10) Patent No.: US 6,628,255 B1
(45) Date of Patent: Sep. 30, 2003

(54) VIEWING ANGLE ADJUSTMENT FOR A LIQUID CRYSTAL DISPLAY (LCD)

(75) Inventors: Michael Ferrel, Santa Rosa, CA (US); Corydon J. Boyan, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/345,219

(22) Filed: Jun. 30, 1999

(51) Int. Cl.[7] ..... G09G 3/36

(52) U.S. Cl. ..... 345/88; 345/63; 345/77; 345/87

(58) Field of Search ..... 345/63, 77, 51, 345/89, 94, 88, 590, 591, 600, 601, 602; 359/81; 349/129

(56) References Cited

U.S. PATENT DOCUMENTS 4,559,535 A * 12/1985 Watkins et al. ..... 345/77
5,162,785 A * 11/1992 Fagard ..... 345/87
5,489,917 A * 2/1996 Ikezaki et al. ..... 345/89
5,625,387 A * 4/1997 Moon ..... 345/211
5,636,043 A * 6/1997 Uemura et al. ..... 359/81
5,751,267 A * 5/1998 Sato et al. ..... 345/96
5,754,150 A * 5/1998 Matsui ..... 345/89
5,877,737 A * 3/1999 Kim et al. ..... 345/89
5,969,700 A * 10/1999 Fitzgibbons et al. ..... 345/87
6,236,384 B1 * 5/2001 Didier et al. ..... 345/51
6,285,344 B1 * 9/2001 Everard et al. ..... 345/3
6,297,790 B1 * 10/2001 Goode et al. ..... 345/87
6,392,657 B1 * 5/2002 Hilliard et al. ..... 345/589
6,414,664 B1 * 7/2002 Conover et al. ..... 345/89

FOREIGN PATENT DOCUMENTS

JP 406022249 A * 1/1994 ..... G09G/3/36
JP 407020814 A * 1/1995 ..... G09G/3/18

* cited by examiner

*Primary Examiner*—Steven Saras
*Assistant Examiner*—Fritz Alphonse

(57) ABSTRACT

Adjustments are made to a displayed image in order to take into account user viewing angle. Brightness values for colors are stored within palette registers. In response to a user indicating a view angle change, brightness values stored in at least some of the palette registers are changed. As brightness values are increased, contrast between color shades is decreased.

20 Claims, 3 Drawing Sheets

VIEWING ANGLE ADJUSTMENT FOR A LIQUID CRYSTAL DISPLAY (LCD)

BACKGROUND

The present invention concerns display products and pertains particularly to adjustments made to a liquid crystal display in order to improve display clarity when viewed at different viewing angles.

LCD video display panels require viewing angles close to perpendicular for optimum image accuracy and definition. Specifically, as the vertical angle changes in one direction, the image becomes brighter and has reduced contrast. In the other direction, the image darkens and has increased contrast.

Prior attempts to improve the image at non-perpendicular viewing angles have focused on changing the intensity of the backlight. This results in less overall brightness of the image, and in many cases increased electro-magnetic interference from the backlight.

SUMMARY OF THE INVENTION

In accordance with the preferred embodiment of the present invention, adjustments are made to a displayed image in order to take into account user viewing angle. Brightness values for colors are stored within palette registers. The palette registers, for example, are within a video controller. In response to a user indicating a view angle change, brightness values stored in at least some of the palette registers are changed. In the preferred embodiment, as brightness values are increased, contrast between color shades is decreased.

For example, the display is a liquid crystal display. Each palette register stores a red brightness value, a green brightness value and a blue brightness value. The user indicates a view angle change by either pressing a view angle index increment button, pressing a view angle index decrement button or via a viewing angle command.

In the preferred embodiment, backlight is left at full intensity, and viewing angle is compensated for only by adjusting the color palette to change the brightness and contrast range of the image. This results in improvement of overall image brightness and overall useful viewing angles.

DESCRIPTION OF THE PREFERRED EMBODIMENT

Figure 1:
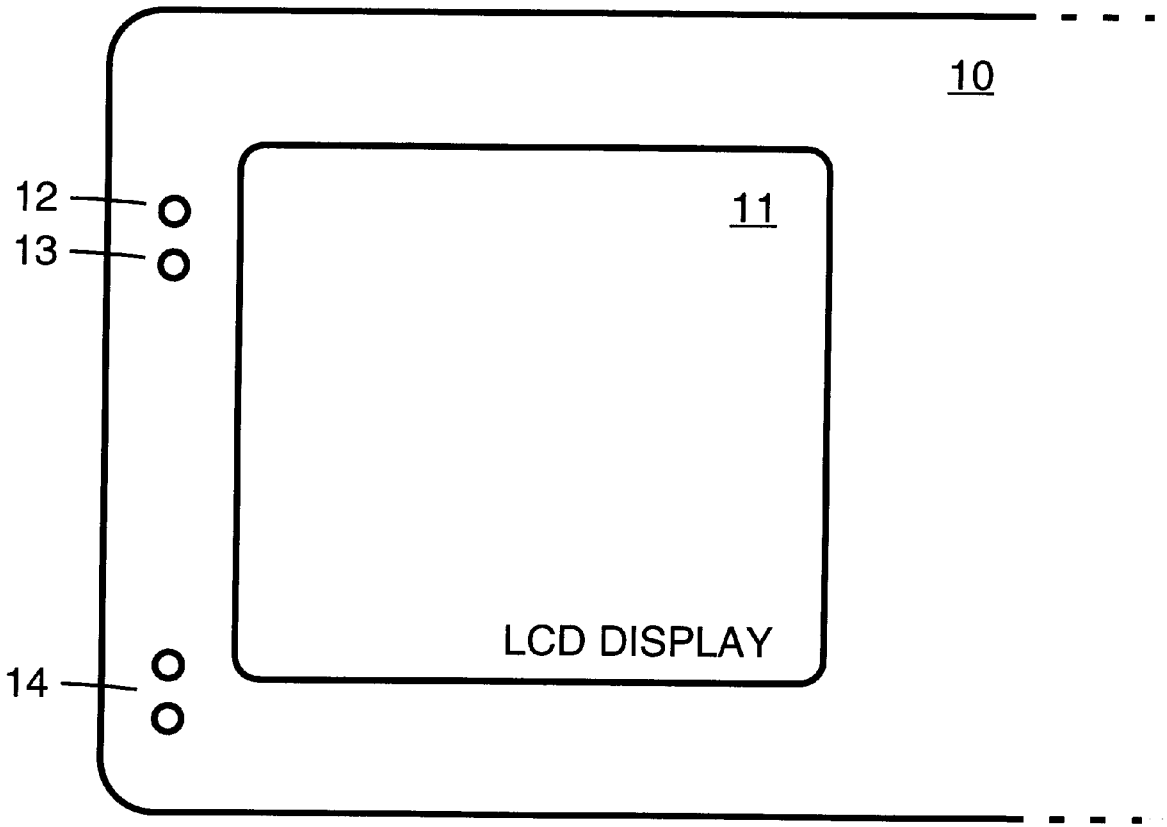
FIG. 1 is a simplified diagram showing an LCD display with buttons used to adjust the viewing image to take into account the angle at which the LCD display is viewed.

FIG. 1 is a simplified block diagram showing a liquid crystal display (LCD) 11 on an instrument panel 10. A button 12 and a button 13 are used to optimize the image projected by LCD display 11 when LCD display 11 is viewed from various angles. For example, button 12 and button 13 adjust the color palette to variously adjust brightness and contrast of the displayed image in order to optimize viewing of LCD display 11 from various angles. Button 12 is used to increase an angle index thus increasing brightness and reducing contrast range of a displayed image. Button 13 is used to decrease an angle index thus decreasing brightness and increasing contrast range of a displayed image. Additional buttons 14 are used for power and/or other input to LCD display 11.

Figure 2:
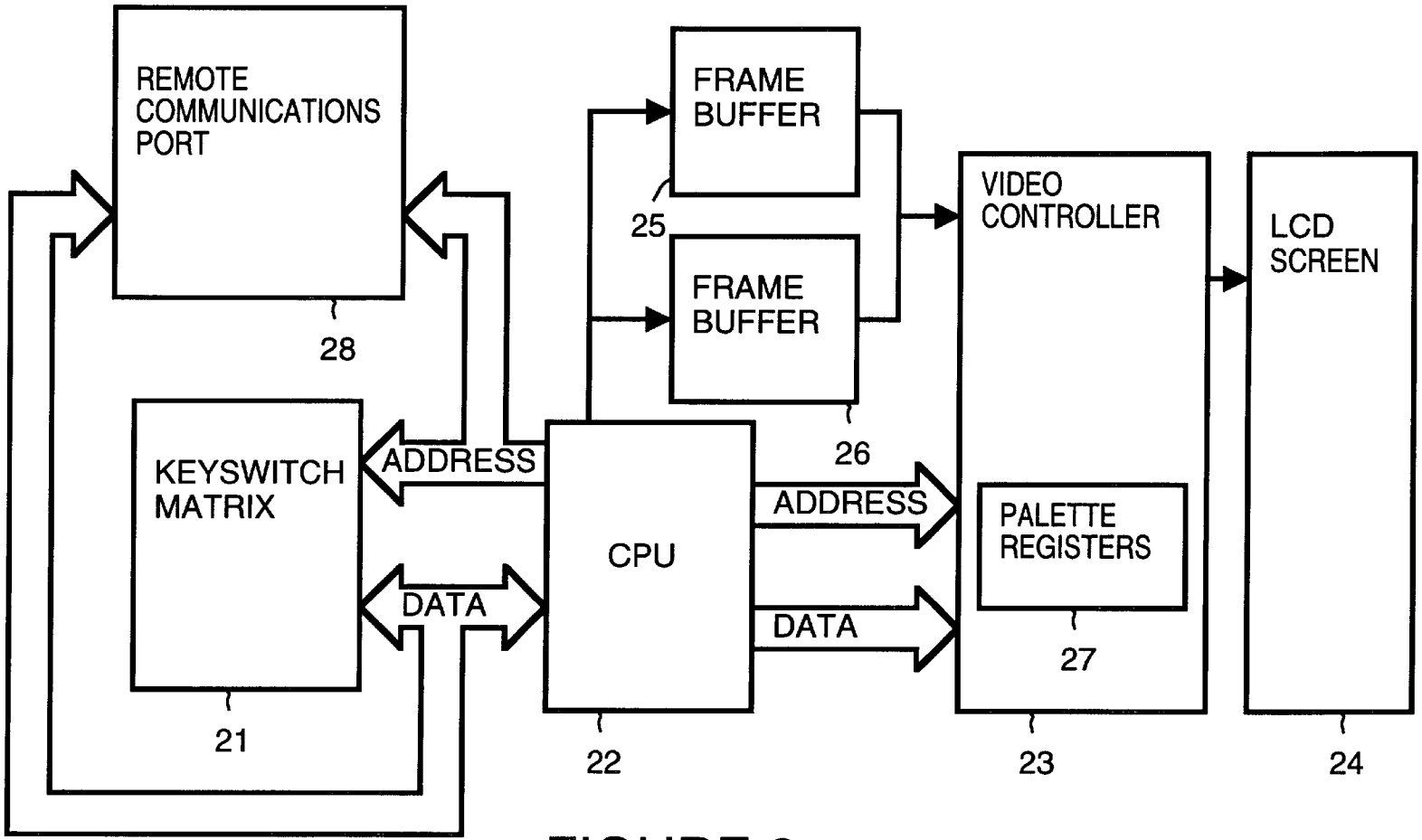
FIG. 2 is a simplified block diagram of a hardware implementation of the display shown in FIG. 1.

FIG. 2 is a simplified block diagram of a hardware implementation of LCD display 11. LCD display 11 includes a central processing unit (CPU) 22, a keyswitch matrix 21, a video controller 23 and an LCD screen 24. CPU 22 places images in frame buffer 25 or frame buffer 26. The active frame buffer contains a pixel value for each pixel in LCD screen 24. Video controller 23 utilizes the pixel values as an index into palette registers 27 in order to obtain red, green and blue values for the pixels to be displayed on LCD screen 24. Using the red, green and blue values for each pixel, video controller 23 places the image on LCD screen 24.

CPU 22 also monitors keyswitch matrix 21 to determine when a button has been depressed. In response to button 12 or button 13 being pressed CPU 22, CPU 22 sends to video controller 23 new values for some or all of the pen values stored within palette registers 13. Changes in the pen values stored in palette registers results in changes in brightness for particular colors and changes in the contrast range between colors for the image displayed on LCD screen 24.

For example, CPU 22 includes a MC68040 processor available from Motorola, Inc., having a business address of P.O. Box 20512, Phoenix Ariz. 85036. Video controller is, for example, a WDC90C24A video controller available from Western Digital Corporation, having a business address of 8105 Irvine Center Drive, Irvine Calif.

A remote communications port 28 allows LCD display 11 to receive commands from an external source. For example, one of the commands is a viewing angle command that changes the viewing angle index to the specific angle index (e.g. 1 through 7) specified in the viewing angle command. In response, CPU 22 changes the values in palette registers 27.

Figure 3:
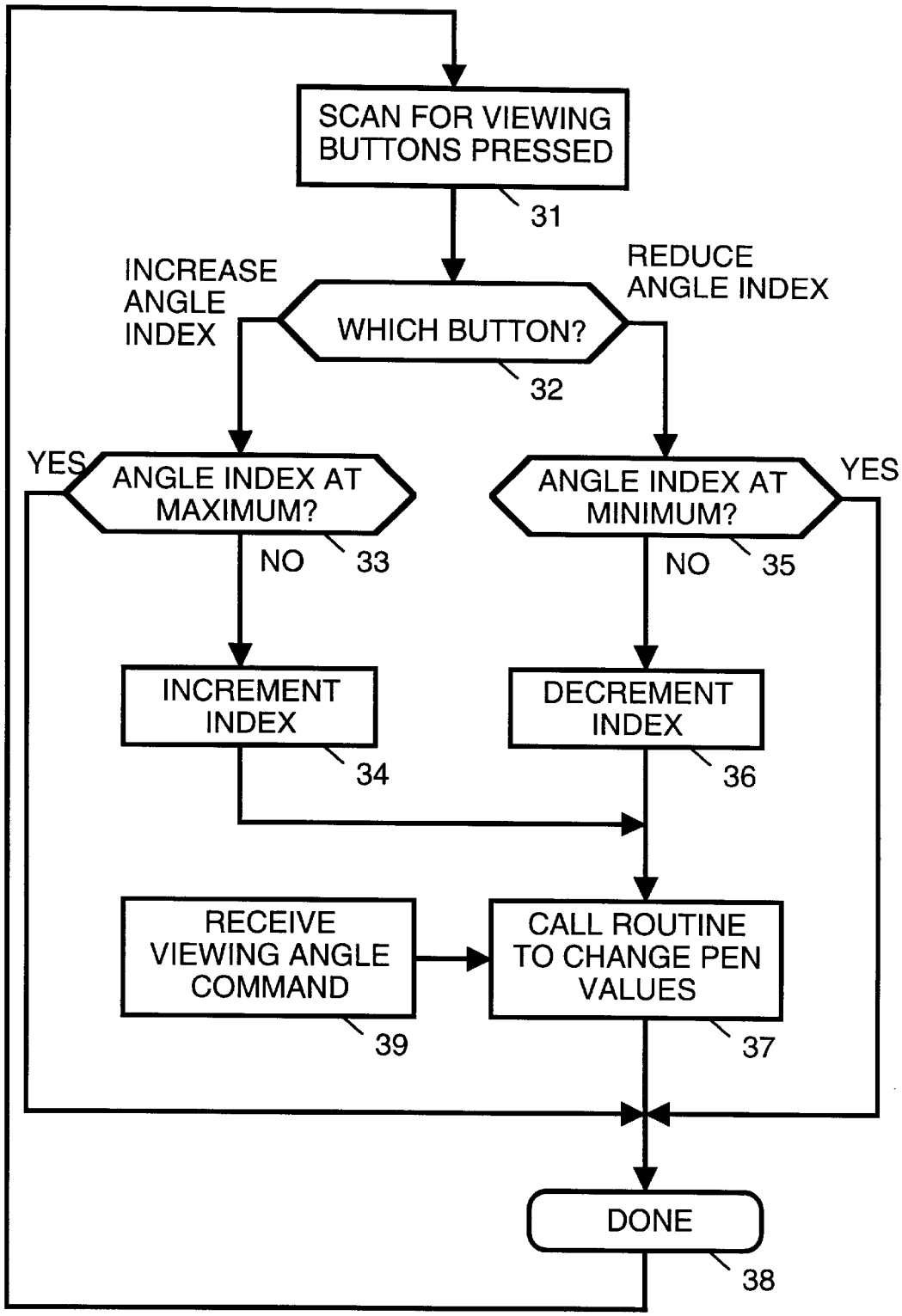
FIG. 3 is a simplified flowchart which illustrates operation of the view angle adjustment feature of the LCD display shown in FIG. 1 in accordance with a preferred embodiment of the present invention.

FIG. 3 is as simplified flowchart of a process which runs on CPU 22 and implements the view angle adjustment feature of LCD display 11. In a step 31, CPU 22 scans keyswitch matrix 21 to determine whether any buttons have been pressed. When a button has been pressed, in a step 32, CPU 22 determines which button has been pressed. If button 12 has been pressed, then, in a step 33, CPU determines whether the angle index is already at a maximum value. If so, in a step 38, this iteration of the process is complete.

If in step 33, CPU determines that the angle index is not already at a maximum value, in a step 34 the angle index is incremented. In a step 37, a routine is called which changes pen values in palette registers 27 based on the current angle index. Then, in step 38, this iteration of the process is complete.

If in step 32, CPU 22 determines that button 13 has been pressed, then, in a step 35, CPU determines whether the angle index is already at a minimum value. If so, in step 38, this iteration of the process is complete.

If in step 35, CPU determines that the angle index is not already at a minimum value, in a step 36 the angle index is decremented. In step 37, that routine is called that changes pen values in palette registers 27 based on the current angle index. Then, in step 38, this iteration of the process is complete.

In step 38, after a delay, the process returns to step 31 for a new iteration.

In a step 39, LCD display 11 receives a viewing angle command from an external source via remote communications port 27. The viewing angle command specifies a specific angle index. Then, in step 37, the routine is called that changes pen values in palette registers 27 based on the current angle index.

As described above, once the angle index is incremented, decremented or changed via a viewing angle command, a routine is called which alters the color palette by modifying some of the pen values stored in palette registers 27 within video controller 23. This provides an increase or decrease in the brightness of the colors used to display the image and a corresponding decrease or increase in the contrast range between colors used to display the image. This results in improvement visibility for a variety of viewing angles.

In the preferred embodiment of the present invention, the pen values of palette registers 27 are altered using a table empirically determined by examining video display 11 at varying angles. Alternatively, an algorithm is used to compute the palette adjustment required for a given angle. Use of an algorithm is particularly helpful for displays with finer brightness gradients.

Table 1 below sets out programming code for an implementation of the routine which alters the color palette for LCD display 11. The implementation shown in Table 1 adjusts the color palette only for those areas of the display which are a shade of gray. Each pen value stored in a palette register contains a brightness value for red between 1 and 64, a brightness value for green between 1 and 64, a brightness value for blue between 1 and 64. In the preferred embodiment, for each color, only sixteen of the possible brightness levels are used. Thus, each valid brightness value is a multiple of four.

The viewing angle value is adjusted using button 12 and button 13. There are seven view angle levels provided, which is the maximum useful number of view angle levels for a display with only 16 brightness levels. More view angle levels are useful when video display 11 has more brightness levels.

For palette registers which specify a gray color, the brightness value for the red, green and blue are equal. In the current application, palette registers 7, 9, 10, 12 and 15 are used to produce gray colors.

The implementation shown in Table 1 also allows display using green only. In this case, for all palette registers, the red and blue brightness values are set to 0.

TABLE 1

```
// The angle table below contains quadruplets for pens (7 & 12), 9,
// 10, 15 for seven different brightness/contrast levels
const uint8 LcDisplay : : angleTable[ ] =
{
    4,    20,    32,    12,
    12,   32,    44,    24,
    20,   44,    52,    28,
    28,   48,    56,    32,
    36,   52,    56,    32,
    44,   52,    56,    36,
    48,   52,    56,    40
}
// The routine below changes the pen values in the palette
//registers.
//The parameters are the angle index (1 to 7) and a Boolean value
//that indicates when green-only display is to be used.
void LcDisplay : : viewAngle (int32 angle, boolean greenPallette)
{
    uint8 const * pValue = angleTable + (angle − 1) * 4;
    extern void setPenValue(int16 pen, int16 r, int16 g, int16 b);
```

TABLE 1-continued

```
    //when in normal mode, set the red, green and blue pen values
    // for palette registers 7, 12, 9, 10 and 15
    if(!greenPallette)
    {
        setPenValue(7, *pValue, *pValue, *pValue);
        setPenValue(12, *pValue, *pValue, *pValue);
        ++Pvalue;
        setPenValue(9, *pValue, *pValue, *pValue);
        ++pValue;
        setPenValue(10, *pValue, *pValue, *pValue);
        ++pValue;
        setPenValue(15, *pValue, *pValue, *pValue);
    }
    else
    //when in green-only mode, set the green pen values for
    //palette registers 7, 12, 9, 10 and 15
    {
        //set only green values from angle table, leave r & b 0
        setPenValue(7, 0, *pValue, 0);
        setPenValue(12, 0, 'pValue, 0);
        ++pValue;
        setPenValue(9, 0, *pValue, 0);
        ++pValue;
        setPenValue(10, 0, *pValue, 0);
        ++pValue;
        setPenValue(15, 0, *pValue, 0);
    }
}
```

As can be discerned from the angle table within the programming code set out in Table 1 above, as the brightness is increased the contrast between shades of gray is decreased.

While the programming code in Table 1 above only changes the palette registers for gray values, in alternate embodiments of the present invention, compensation can be made for the hue shift associated with viewing angle. This is also done by changing the values in the palette registers as described above.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A method for adjusting a display to take into account user viewing angle, the method comprising the steps of:

(a) storing brightness values for a plurality of displayed colors, the brightness values being used to control color palette for the display, the color palette for the display being used to form other colors and shades of colors from the plurality of displayed colors for which brightness values are stored; and, (b) in response to a user indicating a view angle change, changing at least some of the brightness values.

2. A method as in claim 1 wherein the display is a liquid crystal display.

3. A method as in claim 1 wherein in step (a), the brightness values are stored in registers and wherein each register stores a red brightness value, a green brightness value and a blue brightness value.

4. A method as in claim 1 wherein in step (b) the user indicates a view angle change by one of pressing a view angle index increment button and pressing a view angle index decrement button.

5. A method as in claim 1 wherein in step (a) the brightness values are stored in registers within a video controller.

6. A method as in claim 1 wherein in step (b) as brightness values are increased, contrast between color shades is decreased.

7. A method as in claim 1 wherein in step (b) the user indicates a view angle change via a change viewing angle command.

8. A display system comprising:

a display screen;

a video controller, the video controller including:

registers that store brightness values for a plurality of colors displayed on the display screen, the brightness values within the registers being used to control color palette of images on the display screen, the color palette being used to form other colors and shades of colors from the plurality of colors for which brightness values are stored; and, adjust means for, in response to a user indicating a view angle change, changing brightness values stored in at least some of the registers.

9. A display system as in claim 8 wherein the display screen is a liquid crystal display.

10. A display system as in claim 8 wherein each register stores a red brightness value, a green brightness value and a blue brightness value.

11. A display system as in claim 8 wherein the adjust means includes a view angle index increment button and a view angle index decrement button.

12. A display system as in claim 8 wherein the adjust means includes a remote communications port for receiving a viewing angle command to change the view angle index.

13. A display system as in claim 8 wherein as brightness values are increased in the registers, contrast between color shades is decreased.

14. A display system as in claim 8 wherein the adjustment means, includes:

a central processing unit that changes brightness values within the registers.

15. A method for adjusting a display to take into account user viewing angle, the method comprising the steps of:

(a) storing pen values for displayed colors, each pen value having brightness values for each primary color utilized by the display; and, (b) in response to a user indicating a view angle change, changing at least a subset of pen values stored in step (a), the pen values being changed so that as brightness of colors is increased, contrast range between colors is decreased.

16. A method as in claim 15 wherein the display is a liquid crystal display.

17. A method as in claim 15 wherein in step (a) the primary colors are red, green and blue.

18. A method as in claim 15 wherein in step (b) the user indicates a view angle change by one of pressing a view angle index increment button and pressing a view angle index decrement button.

19. A method as in claim 15 wherein in step (b) the user indicates a view angle change via a change viewing angle command.

20. A method as in claim 15 wherein in step (a) the pen values are stored in palette registers within a video controller.

* * * * *